US007351116B2

(12) United States Patent
Dold

(10) Patent No.: US 7,351,116 B2
(45) Date of Patent: Apr. 1, 2008

(54) CONNECTING ELEMENT

(75) Inventor: Roland Dold, Furtwangen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 11/384,486

(22) Filed: Mar. 21, 2006

(65) Prior Publication Data

US 2006/0216963 A1 Sep. 28, 2006

(30) Foreign Application Priority Data

Mar. 23, 2005 (DE) ..... 20 2005 004 927 U

(51) Int. Cl.
*H01R 9/26* (2006.01)

(52) U.S. Cl. ..... 439/716; 439/954

(58) Field of Classification Search ..... 439/716, 439/715, 723, 724, 638, 639, 954, 121
See application file for complete search history.

(56) References Cited

U.S. PATENT DOCUMENTS 3,150,907 A * 9/1964 Petroske ..... 439/121
3,757,281 A * 9/1973 Woertz et al. ..... 439/724
5,775,955 A * 7/1998 Graube et al. ..... 439/717
6,146,213 A * 11/2000 Yoon ..... 439/716
6,475,036 B2 * 11/2002 Morikawa ..... 439/716
6,488,527 B2 * 12/2002 Yoon ..... 439/441
6,790,050 B1 * 9/2004 Roth-Stielow et al. ..... 439/76.2
6,802,737 B2 * 10/2004 Bergner et al. ..... 439/532
7,156,694 B1 * 1/2007 Anderson ..... 439/535

* cited by examiner

*Primary Examiner*—Renee Luebke
*Assistant Examiner*—Harshad C Patel
(74) *Attorney, Agent, or Firm*—The Nath Law Group; Jerald L. Meyer; Derek Richmond

(57) ABSTRACT

A connecting element (1), with a housing (2), with attachment means (3, 4, 5) for attaching the housing (2) to a support rail (9), preferably for attaching a top-hat rail (9), and with two connections (10, 11) in the housing (2) for cables (12, 13), particularly for telecommunication and/or data cables, such that each connection (10, 11) defines the direction of feed (18, 19) for the given cable, and the connections (10, 11) are so positioned that the feed directions (18, 19) for the cables (12, 13) enclose an angle smaller than 180°.

5 Claims, 2 Drawing Sheets

CONNECTING ELEMENT

FIELD OF THE INVENTION

The invention relates to a connecting element for connecting two cables, particularly for connecting two telecommunication and/or data cables. The connecting element exhibits a housing, as well as attachment means to permit attachment to a support rail, preferably attachment to a top-hat rail. Also provided on the connecting element are two connections for the cable being connected, such that each connection defines the cable's direction of feed.

BACKGROUND

In known connecting elements that can be mounted on top-hat rails the connections are oriented in opposite directions, so that the feed directions for the cables rest on a straight line, and thus lie at an angle of 180° relative to each other. In the known connecting elements the connections are usually so positioned that the feed direction for guiding the first cable into the first connection (generally a plug-in cable connection) runs from below to above on the front side, while the feed direction for guiding the second cable into the second connection (generally a permanently installed cable connection) runs from above to below on the reverse side. Also known are connecting elements in which the direction of feed runs from diagonally below to diagonally above or from diagonally above to diagonally below; or from front to back or back to front. Since the plug-in cable usually runs to the connecting element from below on the front side, the other cable must be guided downward in a curve, or at least both cables must be bent at angle of 90°.

SUMMARY

The invention is based on the problem of specifying a connecting element which permits a cable to be guided with greater simplicity.

The invention is based on the idea of positioning the connections on a connecting element that is provided with means for attachment to a support rail, in such a way that the feed directions for the two cables being connected enclose an angle smaller than 180° in a plane perpendicular to that of the mounting rail. Depending on the selected angle of the feed directions or, as the case may be, the orientation of the inlet holes, it is possible to feed the cables to the connections belonging to the connecting elements with only a reduced amount of bending. As a result, the time required for assembly is reduced. In addition, the reduced degree of bending acts to conserve the cables, and breaks in the cable are advantageously avoided.

It has also proven to be particularly advantageous if the feed directions for the cables enclose an angle of about 90° in the plane perpendicular to the plane occupied by the mounting rail.

It is advantageous if the connections or, the case may be, the inlet holes are positioned in such a way that when the connecting element is mounted on the vertical wall of a horizontally positioned support rail, particularly a horizontally positioned top-hat rail, the feed direction of at least one of the connections points diagonally upwards or straight upwards from below. This facilitates the cable feed, inasmuch as the cable is generally brought up to the connecting element from below. If one of the connections is oriented straight downwards, i.e., if the feed direction points directly upwards from below, the other connection will not point directly upwards, according to the invention design of the connecting element. This means that the direction of feed for the second connection runs at an angle to the vertical and that the cable there attached can be guided in the downward direction with limited flexion.

It is advantageous if the connections are positioned in such a way that when the connecting element is mounted on a horizontally positioned support rail, particularly on a horizontally positioned top-hat rail, both feed direction runs diagonally upwards. In this case, consequently, both connections, or both inlet holes, are oriented diagonally downwards. In this design of the connecting element it is advantageous if the feed directions enclose an angle of about 90°. Here the connections, or inlet holes, will ideally be positioned in such a way that both directions of feed exhibit an angle of 45° to the vertical. As a result, the two cables when introduced from below must each be bent only 45° from the direction of feed.

The connecting element according to the invention is suited, e.g., for the use of RJ-45 plugs. In this case the connections are designed as RJ-45 jacks.

In order to provide the connecting element with a range of use that is as variable as possible, it is advantageously provided that the attachment means can be secured to the housing in detachable fashion.

BRIEF DESCRIPTION OF THE DRAWINGS

The invention is next described in greater detail on the basis of exemplary embodiments depicted in the drawing.

Shown are.

DETAILE DESCRIPTION

Figure 1:
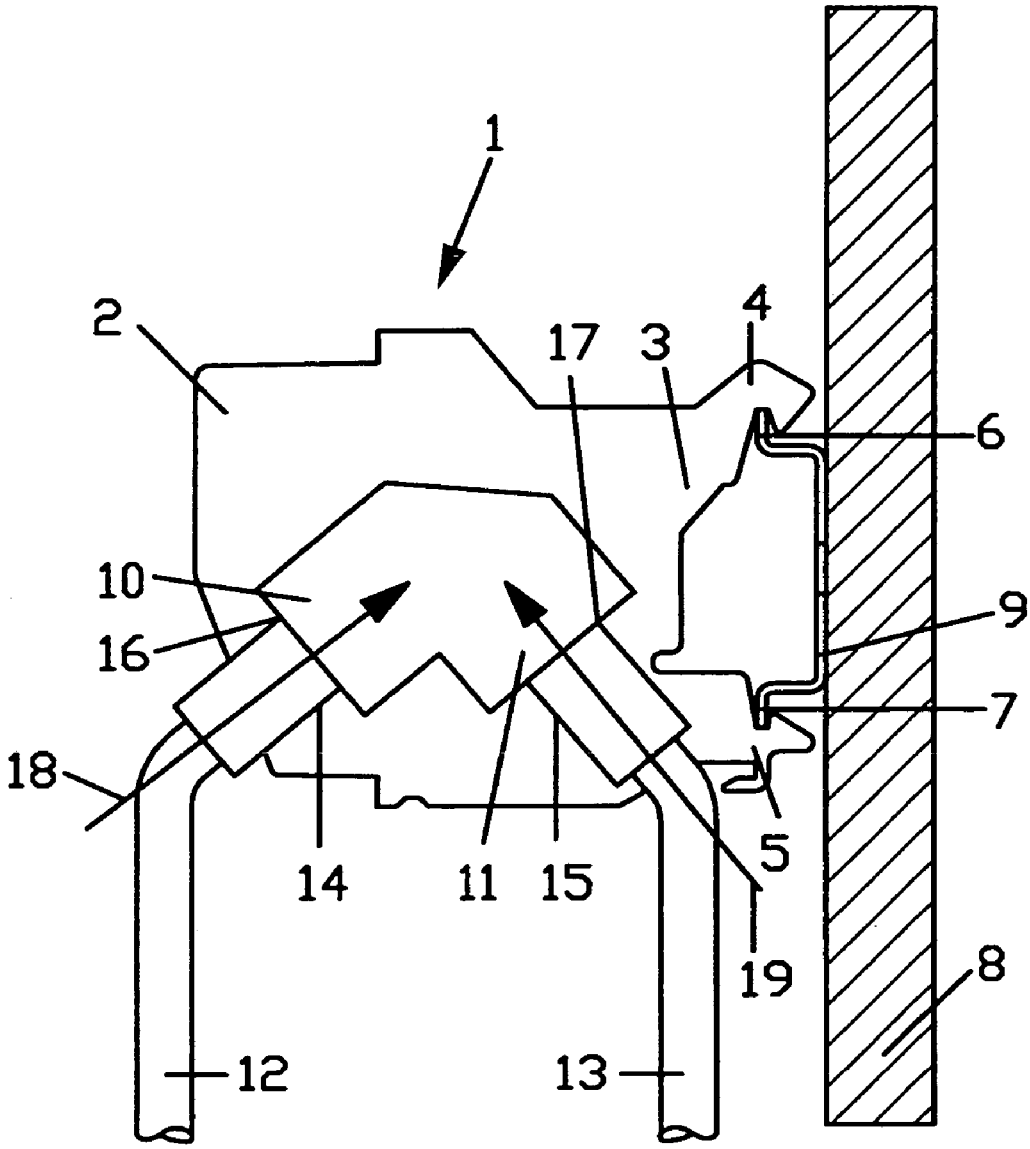
FIG. 1 an initial exemplary embodiment of a connecting element according to the invention FIG. 2 a second exemplary embodiment of a connecting element according to the invention.

In the figures, identical components, or components with the same function, are given identical reference numerals.

FIG. 1 shows a connecting element 1 with a plastic housing 2. Forming a single piece with the housing 2 is a locking bracket 3 with two opposing catches 4, 5. Each catch 4, 5 locks with the rim flange 6, 7 of a top-hat rail 9, which runs horizontally and is mounted on a vertical wall 8.

Provided in the housing are two connections 10, 11, which are designed, e.g., as RJ-45 jacks. Each connection is intended to receive a plug, e.g., an RJ-45 plug, 14, 15, which is attached to a cable 12, 13.

Both of the inlet holes 16, 17 are oriented diagonally and downwards. Each connection 10, 11 has a direction of feed 18, 19 along which the cables 12, 13 are introduced into the inlet holes 16, 17 and thus into the connections 10, 11. In the depicted embodiment the connections 10, 11 are positioned in such a way that the feed directions 18, 19 enclose an angle of 90° in the plane perpendicular to the wall 8. Each feed direction 18, 19 intersects the vertical at an angle of 45°. The feed directions 18, 19 run diagonally and upwards.

In the area bordering the plugs 14, 15 the cables 12, 13 are each bent about 45° relative to the direction of feed 18, 19. Both cables can be fed into the connections 10, 11 from diagonally below to diagonally above.

Figure 2:
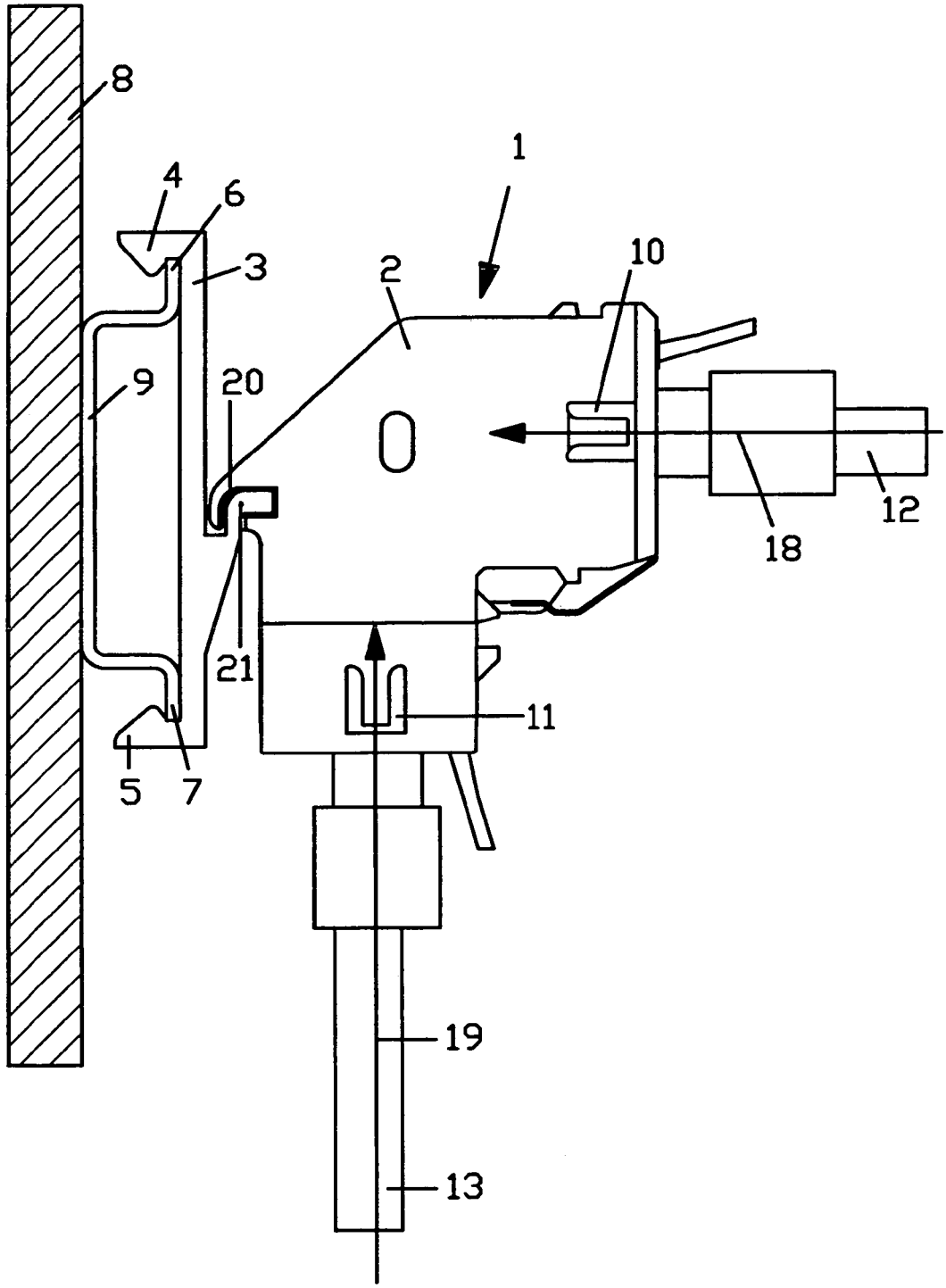

FIG. 2 shows another connecting element 1. In the connecting element 1 shown in FIG. 2 the directions of feed 18, 19 also meet at an angle of 90°. In contrast to the exemplary embodiment depicted in FIG. 1, the feed direction 19 of the connection 11 runs straight up from below. The feed direction 18 of the connection 10 runs from right to left in the plane of projection, perpendicular to the top-hat rail 9 and the wall 8.

In the connecting element shown in FIG. 2 the locking bracket 3 is designed as an adapter and is secured to the housing 2 in detachable fashion. Provided to this end in the housing 2 is a seat hole 20, into which an extension 21 of the locking bracket 3 is inserted.

In both the embodiments it is possible for the cable 13, which is generally installed in permanent fashion, to be guided so as to rest against the wall 8. The cable 12, which generally is inserted in a variable fashion, can be inserted from the front side in a way that makes it easily accessible.

For the sake of simplicity, the figures do not depict the electrical connections between the connections 6, 7 in either of the exemplary embodiments; also not depicted are the contacts for the plugs 14, 15 and the contacts for the connections 6, 7.

LIST OF REFERENCE NUMERALS

1 connecting element
2 housing
3 locking bracket
4 catch
5 catch
6 rim flange
7 rim flange
8 wall
9 top-hat rail
10 connection
11 connection
12 cable
13 cable
14 plug
15 plug
16 inlet hole
17 inlet hole
18 direction of feed
19 direction of feed
20 seat hole
21 extension

The invention claimed is:

1. A connecting element (1), with a housing (2), and with attachment means (3, 4, 5) for attaching the housing (2) to a support rail (9), and with two connections (10, 11) in the housing (2) to serve cables (12, 13), such that each connection (10, 11) determines the direction of feed (18, 19) for said cable (12, 13), wherein the connections (10, 11) are so positioned that the feed directions (18, 19) for the cables (12, 13) enclose an angle smaller than 180°, and wherein the connections (10, 11) are positioned such that when the attachment means (3, 4, 5) is mounted on a horizontally positioned support rail (9) in direct contact with a vertical wall, the feed directions (18, 19) for both connections (10, 11) are generally upwardly oriented, wherein the feed directions (18, 19) for the cables (12, 13) enclose an angle of about 90°.

2. A connecting element according to claim 1, wherein the connections (10, 11) are so positioned that when the connecting element (1) is mounted on the horizontally positioned support rail (9) both feed directions (18, 19) are orientated diagonally upwards.

3. A connecting element according to claim 1, wherein at least one connection (10, 11) is designed in the form of RJ-45 jacks.

4. A connecting element according to claim 1, wherein the attachment means (3, 4, 5) can be secured to the housing (2) in a detachable manner.

5. A connecting element (1), with a housing (2), and with attachment means (3, 4, 5) for attaching the housing (2) to a support rail (9), and with two connections (10, 11) in the housing (2) to serve cables (12, 13), such that each connection (10, 11) determines the direction of feed (18, 19) for said cable (12, 13), wherein the connections (10, 11) are so positioned that the feed directions (18, 19) for the cables (12, 13) enclose an angle smaller than 180°, and wherein the connections (10, 11) are positioned that when the attachment means (3, 4, 5) is mounted on a horizontally positioned support rail (9) in direct contact with a vertical wall, the feed directions (18, 19) for both connections (10, 11) are generally upwardly oriented, wherein the connections (10, 11) are so positioned that when the connecting element (1) is mounted on the horizontally positioned support rail (9) both feed directions (18, 19) are orientated diagonally upwards, wherein the connections (10, 11) are so positioned that one of the feed directions (18, 19) runs at an angle of +45° to the vertical and the other feed direction (18, 19) runs at an angle of−45° to the vertical.

* * * * *